US007437895B2

(12) United States Patent
Okuno

(10) Patent No.: US 7,437,895 B2
(45) Date of Patent: Oct. 21, 2008

(54) SEAMLESS GLOVE OF HIGH SUPPORT PERFORMANCE

(75) Inventor: Masao Okuno, Wakayama (JP)

(73) Assignee: Shima Seiki Mfg., Ltd, Wakayama (JP)

( * ) Notice: Subject to any disclaimer, the term of this patent is extended or adjusted under 35 U.S.C. 154(b) by 175 days.

(21) Appl. No.: 10/574,965

(22) PCT Filed: Oct. 7, 2004

(86) PCT No.: PCT/JP2004/014837

§ 371 (c)(1),
(2), (4) Date: Apr. 7, 2006

(87) PCT Pub. No.: WO2005/034664

PCT Pub. Date: Apr. 21, 2005

(65) Prior Publication Data

US 2007/0113592 A1 May 24, 2007

(30) Foreign Application Priority Data

Oct. 10, 2003 (JP) ..... 2003-352802

(51) Int. Cl.
*D04B 7/34* (2006.01)

(52) U.S. Cl. ..... 66/65; 66/174

(58) Field of Classification Search ..... 66/64, 66/65, 69, 174, 60 R; 2/169
See application file for complete search history.

(56) References Cited

U.S. PATENT DOCUMENTS 2,877,635 A * 3/1959 Powell ..... 66/65
3,115,760 A * 12/1963 Pierce ..... 66/65
3,788,103 A * 1/1974 Asai ..... 66/65
3,916,647 A * 11/1975 Yabuta ..... 66/65
4,055,201 A 10/1977 Fowler et al.
4,840,635 A 6/1989 Smith et al.
5,239,846 A * 8/1993 Kitaura et al. ..... 66/174

(Continued)

FOREIGN PATENT DOCUMENTS

DE 2502574 A1 7/1975

(Continued)

OTHER PUBLICATIONS

Nguyen Hai Dang et al., "Neue 3D-Vektororientierte . . . " by mELLIAND Textilberichte, vol. 85, No. 6, pp. 450-451 (Jun. 2004).

*Primary Examiner*—Danny Worrell
(74) *Attorney, Agent, or Firm*—Rothwell, Figg, Ernst & Manbeck, PC

(57) ABSTRACT

The present invention aims to provide a seamless glove of high support performance knitted by flat knitting.

The seamless glove has a base knitted fabric set up knitting from a tip of finger toward a mouth or from the mouth toward the tip of finger and knitted in such a manner that respective fingers, a four-finger body, a five-finger body are knitted on a rib knit structure basis using a stretch elastic yarn, and an elastic yarn in a tensed state is inlaid in the base knitted fabric. The base knitted fabric is knitted on a rib jacquard structure basis, and the inlay yarn is knotted at a location at which the knitting of the finger starts and at a finger crotch part, to prevent cast-off of the inlay yarn.

8 Claims, 3 Drawing Sheets

U.S. PATENT DOCUMENTS

| | | | | |
|---|---|---|---|---|
| 5,429,555 | A | 7/1995 | Beckh | |
| 5,467,616 | A | 11/1995 | Loquet et al. | |
| 5,628,209 | A | 5/1997 | Ikegami | |
| 6,006,551 | A | 12/1999 | Nonnenmacher et al. | |
| 6,158,253 | A | 12/2000 | Svoboda et al. | |
| 6,301,939 | B1 | 10/2001 | Kimmich et al. | |
| 6,578,389 | B1 | 6/2003 | Okamoto et al. | |
| 6,945,080 | B2 * | 9/2005 | Maeda et al. | 66/65 |
| 6,981,392 | B2 * | 1/2006 | Miyai | 66/65 |
| 7,043,329 | B2 | 5/2006 | Dias et al. | |
| 7,047,768 | B2 * | 5/2006 | Miyai | 66/64 |
| 2006/0021390 | A1 | 2/2006 | Gebel et al. | |

FOREIGN PATENT DOCUMENTS

| | | | |
|---|---|---|---|
| DE | 4317652 | C2 | 1/1994 |
| DE | 19605002 | A1 | 8/1997 |
| DE | 19652612 | A1 | 6/1998 |
| DE | 10358146 | A1 | 7/2005 |
| EP | 1679012 | A1 | 7/2006 |
| FR | 2633512 | | 1/1990 |
| FR | 2781816 | A1 | 2/2000 |
| FR | 2781816 | B1 | 2/2000 |
| FR | 2801495 | | 6/2001 |
| GB | 2268756 | | 1/1994 |
| JP | 7-111022 | | 11/1995 |
| JP | 8-188942 | | 7/1996 |
| JP | 3046511 | A | 12/1997 |
| JP | 11-200123 | A | 7/1999 |
| JP | 2003-253509 | A | 9/2003 |
| JP | 2003-268613 | A | 9/2003 |
| WO | WO 01-16416 | A | 3/2001 |
| WO | WO 01/80798 | A1 | 11/2001 |
| WO | WO 02-052966 | A | 7/2002 |
| WO | WO 03/040449 | A1 | 5/2003 |

* cited by examiner

SEAMLESS GLOVE OF HIGH SUPPORT PERFORMANCE

CROSS REFERENCE TO RELATED APPLICATION

This application is a 35 USC § 371 National Phase Entry Application from PCT/JP2004/014837, filed Oct. 7, 2004, and designating the United States.

TECHNICAL FIELD

The present invention relates to a seamless glove of high support performance knitted by using a flat knitting machine.

BACKGROUND ART

The seamless gloves knitted by the flat knitting machine are known. These gloves are knitted on a plain knit structure basis as a whole (Patent Document 1). The gloves of this type are widely distributed as a working glove and a fashion-use glove. In general, a glove is knitted starting from a fifth finger, followed by the remaining fingers in the order of fourth finger, third finger, and second finger. Then, the part from the fifth finger to the second finger is knitted as a single tubular body to form a four-finger body. After the knitting of the four-finger body, a thumb is knitted. Then, the thumb and the previously knitted four-finger body are knitted together to form a five-finger body. Thereafter, a wrist is knitted, with which the knitting of the glove is ended. In order to prevent cast-off of the glove, an elastic yarn is inlaid in the wrist part of the glove by the inlay knitting to provide stretch for the wrist part.

Another type of gloves is also known which are produced by knitting all parts with an elastic yarn. This type of glove is given high stretch so that it can be a one-size-fits-all glove anyone from children to adults can wear.

However, even when the elastic yarn is inlaid in the glove of plain knit by the inlay knitting, since any of the gloves mentioned above is knitted on a plain knit structure basis as a whole, it may be given high expansility but has limitations on its supporting performance. To obtain the glove having a high support performance, a production method wherein the knitted fabric of the rib knit structure in which an elastic yarn is inlaid is formed in a tubular form by sewing is exclusively used under the circumstances. The sewing work requires very complicated treatments including, for example, a treatment to prevent drop of the elastic yarn.

Patent Document 1: JP Examined Patent Publication No. Hei 7-111022

DISCLOSURE OF THE INVENTION

Problem to be Solved by the Invention

It is an object of the present invention to provide a seamless glove of a high support performance knitted by flat knitting.

Means for Solving the Problem

The present invention provides a seamless glove of high support performance knitted by a flat knitting machine, wherein the seamless glove has a base knitted fabric set up knitting from a tip of finger toward a mouth or from the mouth toward the tip of finger and knitted in such a manner that respective fingers, a four-finger body, a five-finger body are knitted on a rib knit structure basis using a stretch elastic yarn, and wherein an elastic yarn in a tensed state is inlaid in the base knitted fabric.

The base knitted fabric is knitted on a rib jacquard structure basis.

The knitting sets up from the tip of finger toward the mouth, the inlay yarn is knotted at least at a location at which the knitting of the finger starts and at a finger crotch part, to prevent cast-off of the inlay yarn, and a front part and a back part of each finger are knitted to be combined with each other by rib knitting of high stitch density, so that when the glove is put in a reversed state, a flat gore is formed at the finger crotch part.

At least a part of the five-finger body on the thumb side is gradually reduced in knitting width by narrowing knitting.

Effect of the Invention

In a seamlessly knitted glove of the present invention, the respective fingers, the four-finger body, the five-finger body are all knitted on a rib knit structure basis using a stretch elastic yarn, and an elastic yarn in a tensed state is inlaid in the rib knit structure. This can produce the result that cast—off of the inlay yarn is prevented and an elastic property of the elastic yarn is not hindered by the sewing, differently from the conventional sewn products. This can allow realization of the glove of high quality and high support performance when a wearer puts on the glove.

Since the knitting starts at the tip of finger, the shaping from the five-finger body toward the wrist part can be achieved by the narrowing knitting. This can prevent exertion of an unreasonable force on the needles, thus facilitating the knitting.

Also, since the inlay yarn is knotted at locations at which treatment of the edge yarn is required, such as a location at which the knitting of the finger starts and a finger crotch part, to prevent cast-off of the inlay yarn, the treatment at a later stage after the knitting can be simplified. In addition, since a front part and a back part of each finger are knitted to be combined with each other by rib knitting of high stitch density in the knitting of the finger crotch part, so that when the glove is put in a reversed state, the edge yarn is hidden in the inside and also a flat gore is formed at the finger crotch part.

When the glove is knitted on a rib jacquard structure basis, a litter or character or a pattern of something can be presented on the front side of the glove.

BEST MODE FOR CARRYING OUT THE INVENTION

Next, a preferred embodiment of the present invention will be described in detail with reference to the accompanying drawings.

FIG. 1 shows a glove 1 knitted in this embodiment. A base knitted fabric of the glove 1 is knitted on a two-color rib jacquard structure basis. In this embodiment, for example a flat knitting machine available from Shima Seiki Mfg., Ltd. (Product name: SWG-183SW of 16 gauge) is used for the knitting. This flat knitting machine is equipped with a carriage having three knitting cams and a comb (a set up needle) to allow transfer of loops between front and back needle beds and pull down of a set-up part of the knitted fabric. Also, an elastic yarn feeding device is additionally provided in the flat knitting machine so that the elastic yarn inlaid can be fed in the tensed state. The tension to be exerted on the elastic yarn can be set, for example, by specifying a yarn length (mm) of the elastic yarn in an unloaded state with respect to a needle pitch between the needles. For example, in the illustrated embodiment, a yarn length of 0.6 mm, about half the length of the needle pitch, is specified. As the carriage is moved, the preset amount of elastic yarn is fed to needles sequentially.

In the illustrated embodiment, a double covered yarn using e.g. Lycra (800 dtex) available from Du Pont as a core yarn is used for the inlay, and four, high-stretch, wooly nylons (70 denier/2) are used for the jacquard part of the base knitted fabric. It is needless to say, however, that the elastic yarn that may be used is not limited to those cited above and as long as the elastic yarn used is the one that can produce substantially the same performance, it can be substituted for the elastic yarn cited above.

FIG. 2 shows the knitting provided by respective knitting cams of the carriage, i.e., a leading knitting cam for the inlay knitting using the elastic yarn and for a color A rib jacquard knitting, an intermediate knitting cam for a color B rib jacquard knitting, and a trailing knitting cam for transfer of loops. The leading knitting cam operates so that an inlay-use yarn feeder which is controlled to provide an accelerated timing of yarn feed so that before a needle is moved forward, the inlay yarn can be fed to the needle can be moved together with a common yarn feeder used for feeding a B color yarn.

When the overall glove knitted in a tubular form is knitted on a rib knit structure basis, for example, loops of a front part of the glove are assigned to odd needles, and loops of a back part of the glove are assigned to even needles. Alternate needles on the front and back needle beds are used so that the loops can be transferred between the opposite needle beds in such a manner that when the front part of the glove is knitted, the loops the loops of the back part of the glove are assigned to the needles of the back needle bed, while on the other hand, when the back part of the glove is knitted, the loops of the front part of the glove are assigned to the needles of the front needle bed. This can provide the result that empty needles are always reserved on the opposite needle beds for rib knitting and loop transfer. When the carriage is moved rightwards, the front part of the glove is knitted, and when the carriage is moved leftwards, the back part of the glove is knitted.

FIG. 3 schematically shows the knitting of the glove 1 on the flat knitting machine. The glove 1 is knitted in the following manner. After the knitting to set up is done, the knitting of four fingers of a fifth finger 3 to a second finger 9 proceeds. In the illustrated embodiment, the four fingers are knitted in parallel using four different yarn feeders (not shown), for the purpose of providing improved workability. Specifically, for knitting the respective fingers of A color and B color on a rib jacquard knitting basis, four yarn feeders used for feeding the A color yarn, four yarn feeders used for feeding the B color yarn, and four yarn feeders used for the inlay knitting, i.e., a twelve yarn feeders in total, are prepared. To prevent loosening of the knitted fabric, cross-over yarns extending to locations at which the knitting of the fingers starts and locations at which the knitting of the finger crotches and the knitting of the wrist part are ended are knotted at those locations, respectively, as described in JP Laid-open (Unexamined) Patent Publication No. Hei 8-188942.

A fifth finger set up part 23 and the other finger set up part 21 than the fifth finger set up part are set up knitting, using their respective yarn feeders, as illustrated. 24 designates a set up needle (comb) 24 to capture a set up part of the glove. The fingers knitted are spaced from each other so that the yarn feeders can be stopped between the fingers. FIG. 3-*a* shows the state in which the fifth finger 3, the fourth finger 5, the third finger 7, and the second finger 9 are being knitted after the knitting of the set up parts 21 and 23, Each finger is knitted with its tip open, to form a so-called open-tip finger. When adjacent fingers are joined at the finger crotches during the knitting of the four-finger body shown in FIG. 3-*c*, the knitted fabric is moved and waste knitting is extended for the fifth finger set up part 23 so that the fifth finger can move smoothly. After the knitting of the four-finger body is ended, the respective fingers are joined by overlaying the loops at lateral ends of the respective fingers with each other, as shown in FIG. 3-*b*.

FIG. 4 shows the knitting of the third finger 7 and the fourth finger 5 whose loops are in the held state on the needle beds. FIG. 4-*a* shows the state before the joining of the both fingers by overlapping the loops at lateral ends thereof with each other. FIG. 4-*b* shows the state after the joining. In the drawing, F designates the front needle bed, and B designates the back needle bed. FIG. 4-*c* corresponds to FIG. 4-*b*, showing the held state of the actual loops. Although the front and back parts of the third finger 7 are held with a total of about 20 wales of front and back loops held on the needles, a fewer number of needles used for knitting the respective fingers are presented, for convenience or simplification of explanation of the drawing. The third finger 7 and the fourth finger 5 are joined by overlapping the loops at the both ends thereof with each other. Specifically, when viewed in the drawing, front stitches 5*f*, 7*f* at the ends of the front parts of the fingers and front stitches 5*b*, 7*b* at the ends of the back parts of the fingers are overlapped with each other. Likewise, the fourth finger 5 and the fifth finger 3, and the second finger 9 and the third finger 7 are joined by overlapping the loops at the both ends thereof with each other in the same manner as above (State of FIG. 3-*b*).

Then, the knitting of the thumb 13 proceeds in parallel with the four-finger body 11. The yarn feeder that was used for the knitting of the second finger 9 is used for the knitting of the four-finger body 11, and the yarn feeder that was used for the knitting of the third finger 7 is used for the knitting of the thumb 13, thereby preventing the occurrence of an edge yarn. The waste knitting 21 for the thumb part is extended so that the thumb 13 can move smoothly.

When the carriage is moved rightwards, a course of the front part of the four-finger body 11 is first knitted. This knitting is carried out in the manner as shown in FIG. 4-*d*. FIG. 4-*d* shows a finger crotch part between the third finger 7 and the fourth finger 5 shown in FIG. 4-*c*, or a part of the four-finger body. The loops f, f, of the finger crotch part which should be originally knitted on the back needle bed are held on the front needle bed, then the yarn is fed to those needles and the needles holding the loops r of the back part thereon, and then a fist course of the four-finger body is knitted (FIG. 4-*d*). The same knitting is carried out for the other finger crotch parts, though not shown. Specifically, the respective finger crotch parts are rib-knitted with successive needles, as indicated by 30. The rib-knitted parts have a higher stitch density than the remaining parts and besides each finger is knitted with its front and back parts combined, so that when the glove knitted inside out is reversed for wearing, the edge yarns are hidden in the inside and flat gore are formed at the finger crotches.

After completion of the knitting of the gore shown in FIG. 4-*d*, the back part and the front part are sequentially rib-knitted with every other needles by flechage knitting in the same manner as in the knitting of the finger. FIG. 3-*d* shows a finishing state of the knitting of the thumb 13 and the four-finger body 11. The finger crotch part between the thumb and the four-finger body is also formed in the same manner as in the knitting of the other finger crotches. FIG. 3-*e* shows the knitting of a five-finger body 15. The five-finger body 15 is knitted in such a manner that a part thereof on the thumb side 19 is gradually narrowed, whereby it is shaped to correspond to one's hand. The shaping is carried out by the narrowing knitting, because the five-finger body 15 starts knitting from a tip of finger. While the glove itself is knitted while being highly elasticized, the narrowing can be carried out easily, as compared with the widening. 21 shows a narrowed part of the five-finger part on the fifth finger side. Then, after the knitting of the wrist part 17 is ended, the wrist part is subjected to the bind-of process to prevent loosening of the stitches.

After the glove 1 thus knitted is released from the flat knitting machine, edge yarns extending to the location at which the knitting of the fingers starts and the location at which the kitting of the finger crotch parts or the wrist part ends is cut. Thereafter, the glove is reversed. The glove is finished in the manner described above. When the glove knitted inside out is reversed for use, knotted parts of the yarns and cut parts of the edge yarns are hidden behind, so that the beautiful outline of the glove is not spoiled. Also, since the finger crotch parts are knitted in the manner described above, the gores can be made flat. In addition, when the glove thus knitted is reversed, a part of the wrist part 17 bound off is curled inside, so that when a wearer puts on the glove, the curled wrist part 17 clings tightly to the skin.

When the glove is knitted in such a manner that an amount supplied of the elastic yarn to be inlaid is adjusted in accordance with dimensions of the parts, such as the fingers, the four-finger body, and the five-finger body, to vary a pressure exerted on the skin when a wearer puts on the glove, a higher quality glove can be obtained. This is one of the variants of the present invention. Further, when the fingers are knitted, an amount supplied of the elastic yarn may be adjusted so that the pressure exerted on the skin can be gradually varied from the tip of figure.

In the embodiment illustrated above, the knitting starts at the tip of finger, but instead, the knitting may start at a mouth of the glove and end at the tip of finger. In this case, the widening of the five-finger body is substituted for the narrowing of the same. The glove may be in the form of a closed-tip finger, rather than an open-tip finger. Although the reversed state of the glove is presented as the front side of the glove in the illustrated embodiment, the glove need not necessarily be reversed. Also, when the glove is knitted so that a stitch size of its back part can be slightly larger than that of its palm part, a feeling of tightness to the back part of one's hand can be eased. Further, the knitting technique of the embodiment may be combined with another knitting technique for shaping, to produce a further improved tight-fit glove. Thus, the present invention is widely applicable without being limited to the embodiment illustrated above. Of course, the present invention is applicable to a sock and the like as well as the glove.

INDUSTRIAL APPLICABILITY

Since the glove of the present invention is a seamless knit having a high support performance, the glove of the present invention is widely applicable to various types of gloves including for example a glove for massage use or for medical use for improving a flow of blood, and a glove for sport use.

Explanation of letters or numerals

Figure 1:
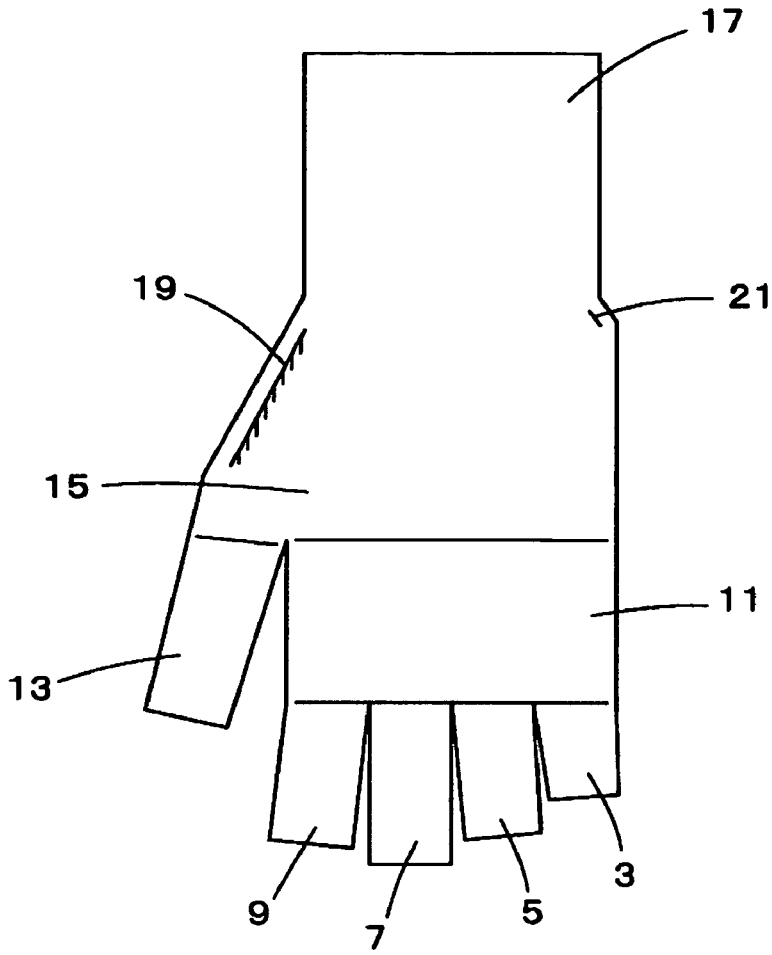
FIG. 1 is a drawing figure showing a glove knitted in the illustrated embodiment.
Figure 2:
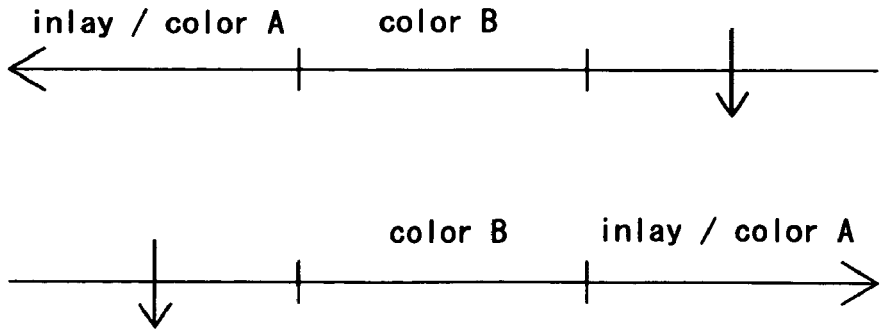
FIG. 2 is a drawing figure showing the knitting provided by respective knitting cams of a carriage, FIG. 3*a*-3*e* schematically shows the knitting of the glove on a flat knitting machine.
Figure 3:
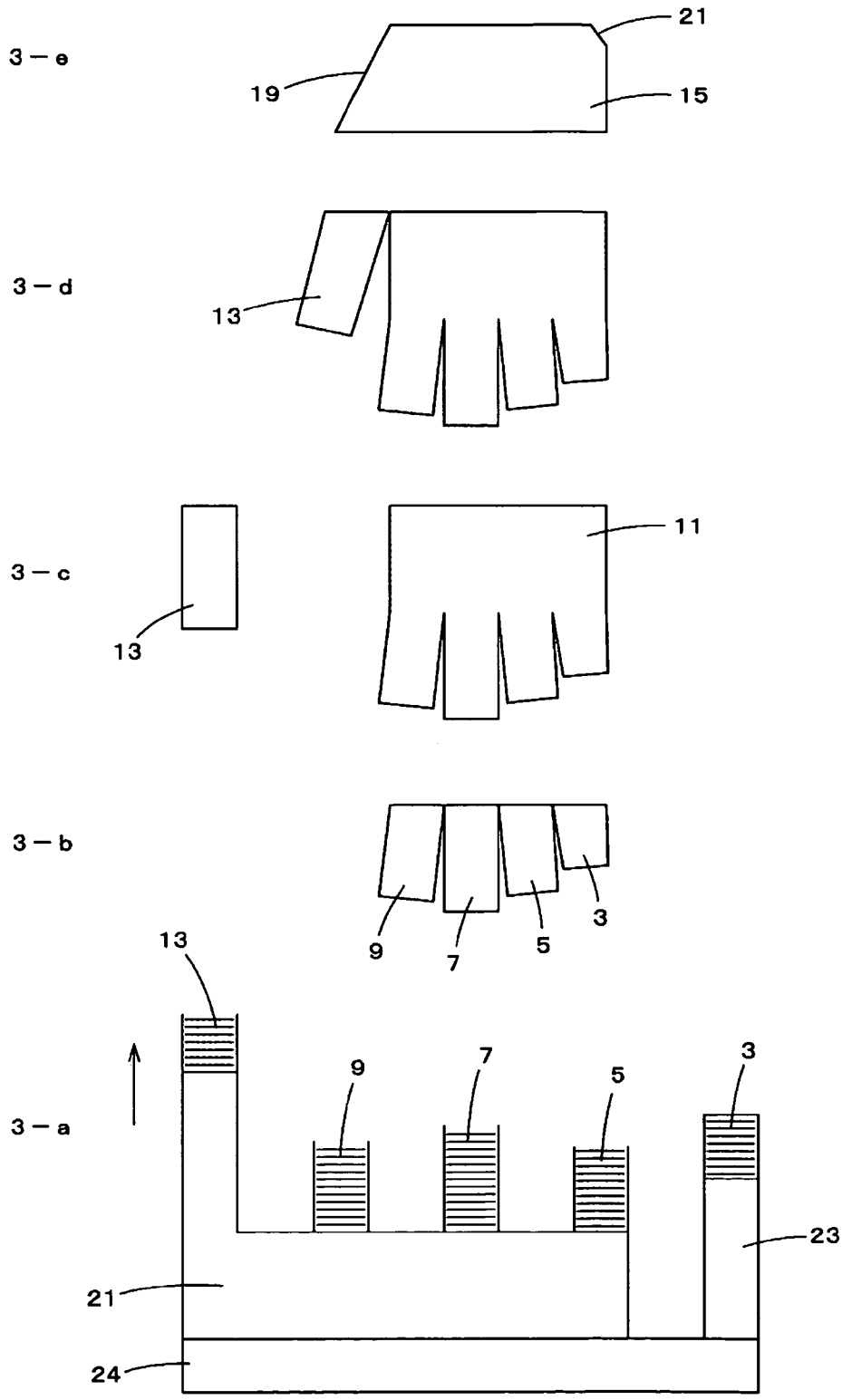
Figure 4:
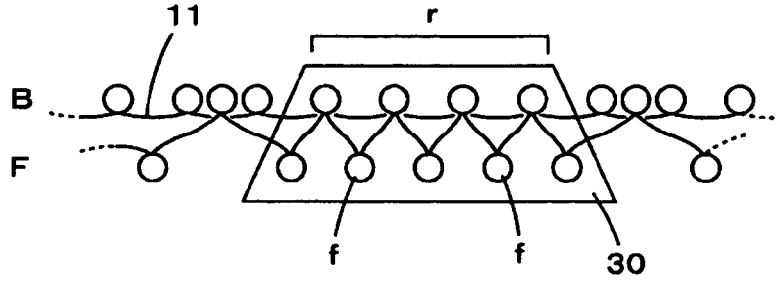
FIG. 4*a*-4*d* shows the state of fingers before being joined and after being joined and showing a part of the knitting of a four-finger body.
Figure 4:
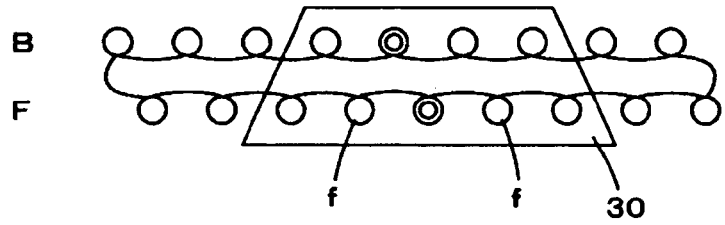
Figure 4:
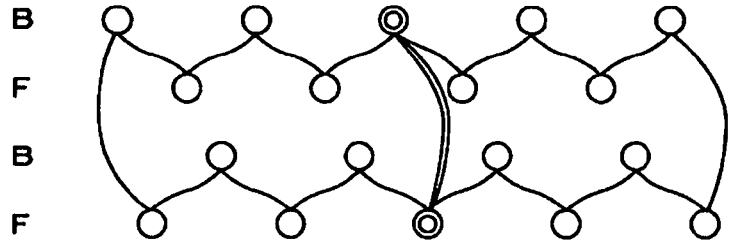
Figure 4:
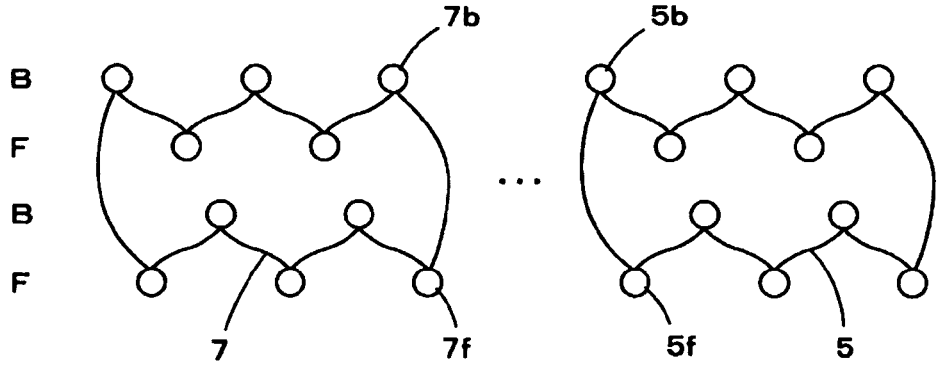

| | | | |
|---|---|---|---|
| 1 | Glove, | 3 | Fifth finger |
| 5 | Fourth finger | 7 | Third finger |
| 9 | Second finger | 11 | Four-finger body |
| 13 | Thumb | 15 | Five-finger body |
| 17 | Wrist part | 19, 21 | Narrowing part |
| 24 | Set up needle (Comb) | | |

The invention claimed is:

1. A seamless glove knitted by a flat knitting machine, wherein the seamless glove has a base knitted fabric set up knitting from a tip of finger toward a mouth and knitted in such a manner that respective fingers, a four-finger body, a five-finger body are knitted on a rib knit structure basis using a stretch elastic yarn, and wherein an elastic yarn in a tensed state is inlaid in the base knitted fabric and the inlay yarn is knotted at least at a location at which the knitting of the finger starts and at a finger crotch part, to prevent cast-off of the inlay yarn.

2. The seamless glove according to claim 1, wherein the base knitted fabric is knitted on a rib jacquard structure basis.

3. The seamless glove according to claim 1, wherein a front part and a back part of each finger are knitted to be combined with each other by rib knitting so that when the glove is put in a reversed state, a flat gore is formed at the finger crotch part.

4. The seamless glove according to claim 3, wherein the width of the five-finger body on the thumb side is gradually reduced toward a wrist part by narrowing knitting.

5. A seamless glove knitted by a flat knitting machine, wherein the seamless glove has a base knitted fabric set up knitting from a tip of a finger toward a mouth or from the mouth toward the tip of the finger and knitted in such a manner that respective fingers, a four-finger body, and a five-finger body are knitted on a rib knit structure basis using a stretch elastic yarn, and wherein an elastic yarn in a tensed state is inlaid in the base knitted fabric.

6. The seamless glove according to claim 5, wherein the base knitted fabric is knitted on a rib jacquard structure basis.

7. The seamless glove according to claim 6, wherein the knitting sets up from the tip of a finger toward the mouth, wherein the inlay yarn is knotted at least at a location at which the knitting of the finger starts and at a finger crotch part, to prevent cast-off of the inlay yarn, and wherein a front part and a back part of each finger are knitted to be combined with each other by rib knitting so that when the glove is put in a reversed state, a flat gore is formed at the finger crotch part.

8. The seamless glove according to claim 7, wherein the width of the five-finger body on the thumb side is gradually reduced by narrowing knitting.

* * * * *